US007610710B2

(12) United States Patent
Brittingham

(10) Patent No.: US 7,610,710 B2
(45) Date of Patent: Nov. 3, 2009

(54) INTERRUPTED THREAD MOUNT PRIMARILY FOR ATTACHING A NOISE SUPPRESSOR OR OTHER AUXILIARY DEVICE TO A FIREARM

(76) Inventor: Kevin Tyson Brittingham, 1434 Hillcrest Rd., Norcross, GA (US) 30093

( * ) Notice: Subject to any disclaimer, the term of this patent is extended or adjusted under 35 U.S.C. 154(b) by 113 days.

(21) Appl. No.: 11/645,911

(22) Filed: Dec. 27, 2006

(65) Prior Publication Data

US 2008/0156183 A1 Jul. 3, 2008

(51) Int. Cl.
*F41A 21/30* (2006.01)
*F41A 21/32* (2006.01)

(52) U.S. Cl. ..... 42/14.4; 181/223

(58) Field of Classification Search ..... 89/14.3, 89/14.4; 181/223
See application file for complete search history.

(56) References Cited

U.S. PATENT DOCUMENTS 2,016,226 A * 10/1935 Clausen ..... 220/240
4,233,737 A * 11/1980 Poehlmann ..... 30/335
5,559,302 A * 9/1996 Latka ..... 89/14.05

* cited by examiner

*Primary Examiner*—Stephen M Johnson
(74) *Attorney, Agent, or Firm*—Greenebaum Doll & McDonald PLLC; Glenn D. Bellamy

(57) ABSTRACT

An apparatus and method for easily, quickly and reliably attaching a noise suppressor or other auxiliary device to the muzzle end of a firearm barrel and for easily, quickly and reliably removing the noise suppressor or other auxiliary device there from through the novel ideal of providing two or more non equal relieved areas of thread. My invention also provides an internal o-ring to provide friction between the muzzle adaptor and the thread mount of a noise suppressor or other auxiliary device.

4 Claims, 1 Drawing Sheet

INTERRUPTED THREAD MOUNT PRIMARILY FOR ATTACHING A NOISE SUPPRESSOR OR OTHER AUXILIARY DEVICE TO A FIREARM

BACKGROUND OF THE INVENTION

1. Field of Invention

This invention generally relates to firearms, specifically to systems for attaching a noise suppressor or other device to the threaded muzzle of a firearm barrel using a thread mount and O-ring.

2. Prior Art

Previous systems exist for attaching noise suppressors to a firearm, and specifically for removing or attaching a noise suppressor to a interrupted threaded muzzle of a firearm. Hiram Maxim first used interrupted threads but his design split the thread interruption in half and provided no o-ring for which to further secure the auxiliary device to a firearm. Evenly reliving the threaded area of both the male and female threads creates a variable in the orientation of the noise suppressor or auxiliary device in its relationship to the muzzle. There is a need for a quick, secure attachment system for mounting noise suppressors to a firearm particularly a threaded muzzle which will withstand the vibrations incidental to firing an automatic pistol or other small arm, provide for an opportunity to quickly remove a noise suppressor from the host firearm.

OBJECTS AND ADVANTAGES

Accordingly several objects and advantages of the present invention are (a) to provide the capability of quickly attaching a thread mount silencer to a threaded barrel (b) to provide an internal o-ring near the shoulder of the barrel which will provide friction between the muzzle of a firearm and thread mount of a noise suppressor or other auxiliary device (c) to provide two or more relieved surface areas of differing dimensions on the threads of a barrel, adaptor or thread mount to facilitate quickly attaching or removing a noise suppressor or other auxiliary device.

Still further objects and advantages will become apparent from a consideration of the ensuing description and drawings.

SUMMARY

The present invention provides an apparatus and method for easily, quickly and reliably attaching a noise suppressor or other auxiliary device to the muzzle end of a firearm, and for easily and quickly removing such device there from. The present invention also utilizes an o-ring inside of the thread mount of a noise suppressor or auxiliary device to provide friction and withstand the vibrations incidental to the discharge of the host firearm. In a preferred embodiment of the invention, a noise suppressor is equipped with a thread mount such as described above, with o-ring located near the barrel shoulder when fixed on a firearm muzzle.

In general terms, the invention provides external apparatus for attachment to a firearm including a barrel having a longitudinal axis, comprising the combination of: a interrupted thread; and an auxiliary device having a bore for coaxially receiving the fixture with internal interrupted thread, such device including a o-ring, and a mating surface More specifically, a preferred embodiment according to the invention provides a interrupted thread mount with two non equal relieved areas of thread which is integral to a noise suppressor apparatus for attachment to a firearm including a barrel having a longitudinal axis, comprising the combination of: an barrel adaptor which is adapted to be attached to the muzzle of the barrel coaxially there with and including an interrupted thread with two non equal relieved areas of thread; and a noise suppressor including a interrupted thread mount with two non equal relieved areas of thread on the back section having a bore for coaxially receiving the barrel adaptor, and including an internal o-ring located near the muzzle entrance of noise suppressor back section which will generate friction between the barrel and noise suppressor.

In a preferred embodiment of the method, the external interrupted thread is provided on the barrel by coaxially affixing a barrel adaptor which incorporates external interrupted threads as a locking surface, and a auxiliary device comprising a noise suppressor with an internal o-ring, and interrupted threads located within the rear mount of the noise suppressor.

DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
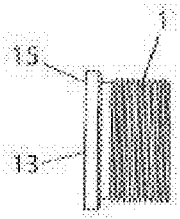
FIG. 1 shows a side view of the preferred embodiment thread mount insert.

Starting with FIG. 1, there is an illustration of an example thread mount 1 showing the external thread 10 used in the preferred embodiment to attach the thread mount 1 to the noise suppressor 12.

Figure 2:
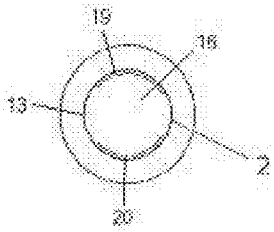
FIG. 2 shows a top view of the female interrupted threads in the thread mount.
Figure 3:
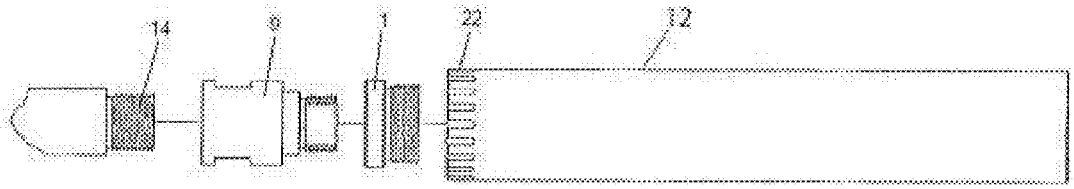
FIG. 3 shows an external side view of a bore, proposed adaptor, and the preferred embodiment for the thread insert, and a noise suppressor.

In FIGS. 2, there is illustrated atop view of the thread mount 1 showing the location of the reduced thread area 2 & 13 as being located on the rear of thread mount 1. An interrupted thread system is depicted where the interruptions are opposed to each other and one interruption or reduced thread area is a smaller, reduced thread area 2, than the larger, reduced thread area 13. Also present are two areas of thread 19 & 20 which provide a means for engaging and receiving the male adaptor 9 illustrated in FIG. 5.

Figure 4:
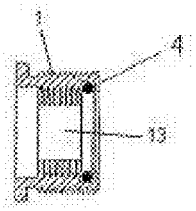
FIG. 4 shows an internal, side view of the preferred embodiment thread mount insert and the location of the o-ring groove, o-ring and interrupted threads.
Figure 5:
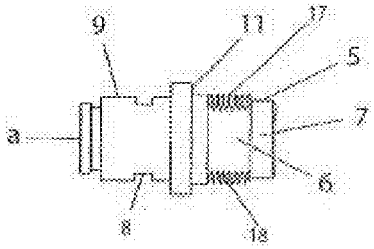
FIG. 5 shows a side view of a barrel adaptor with male interrupted threads.
Figure 6:
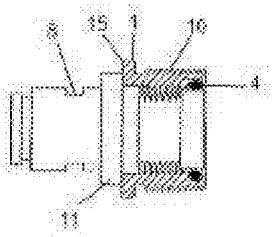
FIG. 6 shows a side view of a barrel adaptor featuring the male interrupted thread insert coupled with the female interrupted thread insert located on the thread mount.

In FIGS. 4-6, there is illustrated in FIG. 4 an internal, side view of the thread mount 1 indicating the location of the o-ring groove 4, and showing the orientation of the reduced thread area 2 in relationship to the o-ring groove 4. FIG. 5 shows a male adaptor 9 with a male threaded portion which has a interrupted portion of thread 6 & 3 (not shown for purposes of clarity) which corresponds in size to the thread of the thread mount 1, and a forward area 7 that will contact the o-ring located in the o-ring groove 4. The o-ring presses against the forward area 7 of the male adaptor 9 and prevents the noise suppressor 12 from becoming threadedly unsecured. The male adaptor 9 is threaded onto a firearm barrel and designed to receive the thread insert 1 indicated in FIG. 4. FIG. 6 shows how the male adaptor 9 in FIG. 5 and the thread mount 1 of FIG. 4 are oriented once the items are coupled together.

FIGS. 5-6 show the location of wrench flats 8 which are present on the male adaptor 9. The wrench flats 8 are two cuts which are parallel to each other.

In a preferred embodiment according to the present invention, the male adaptor 9 is provided with an external mating surface 11. The external mating surface found on the male adaptor 9 may be machined onto a firearms barrel As used herein, the word "forward" or "front" corresponds to the firing direction of the firearm (i.e., to the right as shown in FIGS. 1, 3, 4, 5, and 6); "rear" or "rearward" or "back" corresponds to the direction opposite the firing direction of the firearm (i.e., to the left as shown in FIGS. 1, 3, 4, 5, and 6); "longitudinal" means the direction along or parallel to the longitudinal axis a of the male adaptor 9 or of the noise suppressor body 12; and "transverse" means a direction perpendicular to the longitudinal direction.

The noise suppressor body 12 includes a thread mount 1 having a longitudinal bore for threadedly receiving the male adaptor 9. The noise suppressor body 12 further includes a sound suppressing front section fixedly secured to the thread mount 1. Noise suppressing sections of firearm noise suppressors are well known in the firearms art.

The back section of the thread mount 1 includes an annular seating surface 15 which is perpendicular to the thread mount 1 bore 16. The mating surface 11 present on the male adaptor 9 provides a mating surface when the noise suppressor 12, equipped with the thread mount 1, is attached to the male adaptor 9.

An o-ring s secured within the thread mount 1 by placing it within the o-ring grove 4 located at the front of the thread mount insert 1. The o-ring impinges against the forward area of the male adaptor thereby preventing the noise suppressor 12 from rotating off of the male adaptor 9.

When installing the noise suppressor body 12, equipped with a thread mount 1, onto the male adaptor 9, the engagement of the thread mounts 1 reduced or interrupted thread areas 2 & 13 to the male adaptor's relieved thread area 6 & 3 is limited to being oriented in only one way. The male adaptor 9 has two reduced areas of thread 3 & 6 and two areas of thread 17 & 18 which are designed to lit within the interruption or reduced areas of thread present on the thread mount 1. The noise suppressor 12 may only be oriented one way due to the variable dimensions present on the reduced thread areas of both the thread mount 1 and the male adaptor 9.

To install the noise suppressor body 12 onto the male adaptor 9, the noise suppressor body 12 is placed rearwardly onto the male adaptor's forward area 7 such that the male adaptor 9 is longitudinally received by the thread mount 1, until the reduced thread areas 2-3, 6, & 13 and the threaded portions 17-20 are lined up in a manner which allows them to threadedly engage one another. The noise suppressor 12 is slid down the male adaptor 9 until it seats against the mating surface 11, then the noise suppressor is rotated one half turn until the forward resistance area 5 and o-ring located in the o-ring groove 4, along with the mating surface 11 and annular flat surface 15 of the thread mount 1 fully engage one another respectively. The noise suppressor 12 is threadedly rotated until the annular flat shoulder 15 seats against the mating surface 11, of the male adaptor 9, causing the forward resistance area 5 to press against the o-ring present in the o-ring grove 4 resulting in the noise suppressor body 12 being rotationally restrained.

Upon such installation, the noise suppressor 12 is fixedly secured to the male adaptor 9 (and hence to the barrel 14) both longitudinally and rotationally.

To remove the noise suppressor from the firearm barrel 14, the noise suppressor 12 must be rotated in the reverse or unthreading direction, The back section 22 may be forwardly or longitudinally withdrawn from the male adaptor 9 and thereby the barrel 14 when the noise suppressor 12 is moved longitudinally forwardly.

Thus, there has been described a preferred embodiment of an apparatus for easily, quickly and reliably attaching a noise suppressor or other auxiliary device to the muzzle end of a firearm, and for easily and quickly removing the device there from, as well as a method for such attachment. Other embodiments of the present invention, and variations of the embodiment described herein, may be developed without departing from the essential characteristics thereof. Accordingly, the invention should be limited only by the scope of the claims listed below.

CONCLUSION, RAMIFICATION, AND SCOPE

Accordingly the reader will see that, according to the invention, I have provided a system for quickly attaching a noise suppressor to a firearm. I have also afforded any user of my invention the ability to consistently orient the noise suppressor on the host firearms barrel with the two non equal relieved areas of thread. Further is can be seen that the o-ring present as part of the noise suppressor mount reduces the chance of the noise suppressor backing off due to the incidental vibrations resulting from discharging the host firearm.

While my above drawings and description contain many specificities, these should not be construed as limitations on the scope of the invention, but rather as an exemplification of one preferred embodiment thereof. For example the male adaptor 9 described about could easily be incorporated directly onto the barrel of a firearm. The mating surface 11 and associated male relieved thread area 6 can be used with other auxiliary devices meant to be attached to the muzzle of a firearm. The male relieved thread area 6 could incorporate standard threads that lack the novel two non equal relieved areas of thread present on item 6 and 2.

Accordingly, the scope of the invention should be determined not by the embodiments illustrated, but by the appended claims and their legal equivalents."

The invention claimed is:

1. An apparatus for attaching an accessory to a firearm barrel having a longitudinal bore and a muzzle end, said apparatus comprising:

a first adapter piece having a bore and configured for attachment to the muzzle end of the barrel with said bores substantially coaxially aligned and having a portion presenting a threaded connection with a circumference and an axial length;

a second adapter piece configured for attachment to the accessory and having a portion presenting a threaded connection with a circumference and an axial length;

wherein the threaded connection portions of the first and second adapter pieces are configured for threaded interconnection with one another, each portion including a plurality of circumferentially spaced, axially aligned segments of threads and thread interruptions, an interruption of the first piece corresponding in size and position to a threaded portion of the second piece and a threaded portion of the first piece corresponding in size and location to that of an interruption of the second piece, such that the threaded connection of the first and second adapter pieces may be axially slid together when corresponding interruptions and threaded portions are aligned and then turned no more than one half revolution to fully engage threads along the axial length thereof, said segments of threads and thread interruptions having unequal circumferential length such that there is a singular available orientation of the first and second adapter pieces to allow axial sliding engagement.

2. The apparatus of claim 1, wherein the threaded connections of the first and second adapter pieces include a through passageway that is substantially coaxial with the bore of the firearm barrel.

3. The apparatus of claim 1, wherein at least one of the adapter pieces has an unthreaded area axially adjacent the threaded connection portion and the other adapter piece has an unthreaded area axially adjacent the threaded connection portion, said unthreaded areas configured to be in close circumferential contact when the adapter pieces are fully engaged in threaded connection with one another.

4. The apparatus of claim 3, wherein the axially adjacent unthreaded area of the second adapter piece includes an annular groove with an o-ring therein configured to provide substantially sealing engagement between said adapter pieces.

* * * * *